US006552287B2

(12) United States Patent
Janniere

(10) Patent No.: US 6,552,287 B2
(45) Date of Patent: Apr. 22, 2003

(54) ELECTRICAL SWITCH WITH SNAP ACTION DOME SHAPED TRIPPER

(75) Inventor: Alain Janniere, Paris (FR)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/103,314

(22) Filed: Mar. 20, 2002

(65) Prior Publication Data

US 2002/0100676 A1 Aug. 1, 2002

Related U.S. Application Data

(63) Continuation-in-part of application No. PCT/EP00/09631, filed on Oct. 2, 2000.

(30) Foreign Application Priority Data

Oct. 8, 1999 (FR) ..... 9912546

(51) Int. Cl.[7] ..... H01H 13/48; H01H 5/30; H01H 13/52

(52) U.S. Cl. ..... 200/406; 200/5 A; 200/516; 200/557

(58) Field of Search ..... 200/5 R, 5 A, 200/406, 408, 512–517, 553–557

(56) References Cited

U.S. PATENT DOCUMENTS

| | | | | | |
|---|---|---|---|---|---|
| 4,588,877 | A | * | 5/1986 | Mizuta et al. | 200/406 |
| 4,843,197 | A | * | 6/1989 | Kojima et al. | 200/406 |
| 5,660,272 | A | * | 8/1997 | Janniere et al. | 200/517 |
| 5,726,400 | A | | 3/1998 | Masuda | 200/16 D |
| 5,898,147 | A | * | 4/1999 | Domzalski et al. | 200/406 X |
| 6,180,903 | B1 | * | 1/2001 | Chen | 200/406 |
| 6,271,487 | B1 | * | 8/2001 | Domzalski et al. | 200/406 X |
| 6,323,449 | B1 | | 11/2001 | Janniere | 200/406 |

FOREIGN PATENT DOCUMENTS

| | | | | |
|---|---|---|---|---|
| DE | 3132918 A1 | | 5/1982 | H01H/13/52 |
| FR | 2771846 A1 | | 6/1999 | H01H/13/52 |
| WO | WO 01/027952 A1 | * | 4/2001 | H01H/13/52 |

* cited by examiner

*Primary Examiner*—J. R. Scott
(74) *Attorney, Agent, or Firm*—Roger C. Turner

(57) ABSTRACT

An electrical switch includes a snap dome tripper (36) whose center portion (37) snaps down when depressed by a predetermined amount, and a contact plate (44) with blades (50) that move down against terminals (26) to close the switch when the tripper snaps down, and to provide tactile feedback when the switch is closed. Instead of the center portion of the contact plate lying under the center portion of the tripper, the contact plate lies above the tripper and the contact blades project horizontally beyond the boundaries of the periphery of the tripper.

11 Claims, 3 Drawing Sheets

ELECTRICAL SWITCH WITH SNAP ACTION DOME SHAPED TRIPPER

CROSS-REFERENCE TO RELATED APPLICATION

This is a continuation-in-part of PCT application PCT/EP00/09631 filed Oct. 2, 2000, which claims priority from French application No. 9912546 filed Oct. 8, 1999.

BACKGROUND OF THE INVENTION

One type of electrical switch, described in U.S. Pat. No. 6,323,449, includes a contact plate that forms a plurality of blade that can be downwardly deflected against stationary terminals on a support. The contact blades are moved down by a tripper, and especially a snap tripper which includes a center portion that suddenly snaps down when it is depressed by a predetermined distance. In the earlier patent, the snap tripper was of rectangular shape and lay above the contact blades, and when the tripper was depressed it suddenly snapped down and downwardly deflected the contact blades. A snap tripper is desirable to provide tactile feedback to indicate when the switch has closed. It would be desirable if a switch could be provided with a contact plate having contact blades that suddenly moved down against terminals, without requiring the tripper to actually push down the contact blades.

SUMMARY OF THE INVENTION

In accordance with one embodiment of the present invention, an improved electrical switch is provided, of the type that includes a plurality of terminals mounted on an insulative support, a contact plate having blades lying over the terminals, and a tripper with a center portion that snaps down. The tripper center portion lies below the contact plate center portion instead of above it. When the contact plate center portion is depressed, it and the tripper center portion slowly move down until the tripper suddenly snaps down and the contact plate also snaps down. This causes the blades of the contact plate to suddenly move down against the terminals to close switch portions of the switch.

The tripper can be of the efficient dome shape with a largely circular periphery. The contact blades of the contact plate have free ends that extend beyond the periphery of the tripper, so the tripper does not lie in the way of movement of the free ends of the blades against the terminals. The contact plate has a pair of stabilizing branches that are permanently bent at downward inclines so their free ends are positioned by the support to thereby fix the orientation of the contact plate.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
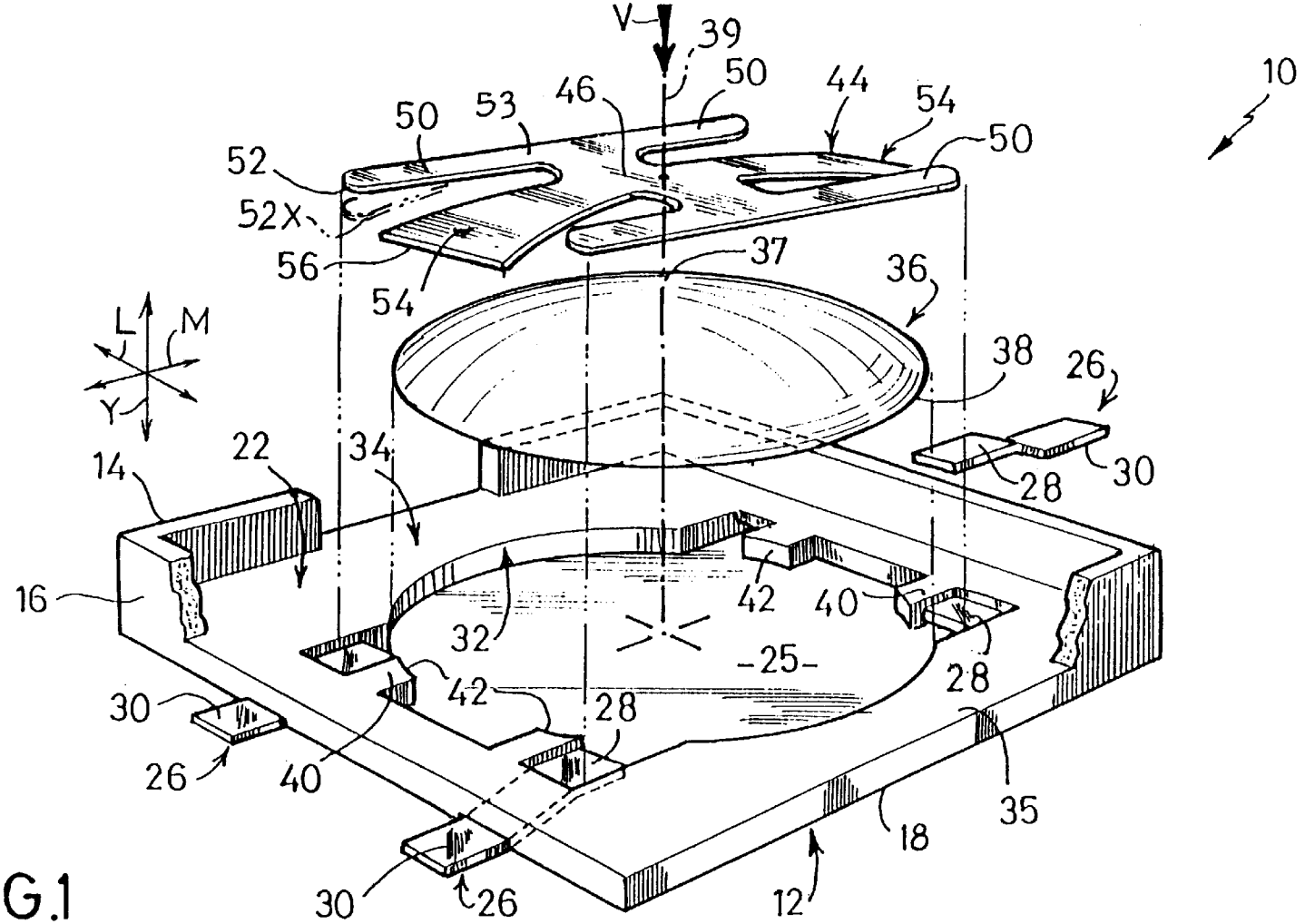
FIG. 1 is an exploded perspective view of a switch of one embodiment of the invention, and with a downwardly-bent blade end shown in phantom lines.

FIG. 1 illustrates a switch 10 which includes a support 12 molded of an insulative plastic and of largely rectangular shape when viewed along a vertical Y direction or along lateral L or longitudinal M directions. The support has laterally opposite side walls 14 and longitudinally opposite end walls 16. The support has a support plate 34 with lower and upper faces 18, 35. A cavity 32 in the support plate has a cavity bottom surface 25. It is possible to form a through cavity at 32, where the lower face is formed by the upper face of a circuit board. The region at the cavity 32 or slightly above it is the support bottom portion.

The switch has four terminals 26 which are mounted on the support 12, as by molding them in the support. Each terminal 26 is formed of a metal strip that is bent, with it inner end 28 located substantially in the cavity 32 and an outer end 30 projecting to the outside of the support. In a common use of the switch, where it is mounted on a circuit board, the outer ends 30 of the four terminals are soldered to traces on the circuit board.

The switch includes a tripping member or tripper 36 in the form of a dome with a substantially spherical periphery 38 and with a center portion 37 that is highest and that lies along a vertical axis 39. (It does not matter if there should be small holes in the tripper and contact plate at the axis). The cavity 32 has side walls with portions that are spaced about the axis and which lie adjacent to the periphery of the tripper to closely position it in the switch.

The tripper has a convex upper surface and concave lower surface. When a downward force is applied along the downward arrow V, the center portion 37 of the tripper resiliently resist downward deflection until the center portion is depressed by a predetermined distance from its initial orientation. At that instant, the resistance to further downward movement decreases to almost zero. Accordingly, if a downward force is applied to the tripper center portion 37, the tripper will slowly move down until it suddenly "gives way" and rapidly moves down under the downward force. It is noted that some trippers do not merely provide almost zero resistance to downward force but actually propel themselves downwardly when depressed a predetermined amount, and applicant can use such trippers.

A contact plate 44 is provided, which is constructed of a resilient conductive metal, preferably sheet metal, which is cut into the shape illustrated. The contact plate 44 has four contact blades 50 with free ends 52. The contact plate 44 also has two stabilizing branches 54 that also have free ends 56. The contact blades, or blades 50 and stabilizing branches 54 each extends from the center portion 46 that lies on the axis 39. It may be noted that the center portion can be considered to extend in a lateral L direction between inner ends 53 of the blades 50 (opposite their free ends 52). It is possible to have the blades extend from the stabilizing branches.

The rounded outer end 52 of each contact blade lies over the inner end 28 of a corresponding one of the four terminals 26. In the initial or rest state of the contact plate 44, shown in FIG. 4, the blades 50 extend largely horizontally, with their free outer ends 52 spaced above the terminal inner ends 28. When the center portion 46 of the contact plate is depressed, the blade outer ends 52 move down against the terminal inner ends 28 to close a plurality of switches, or switch parts.

Figure 2:
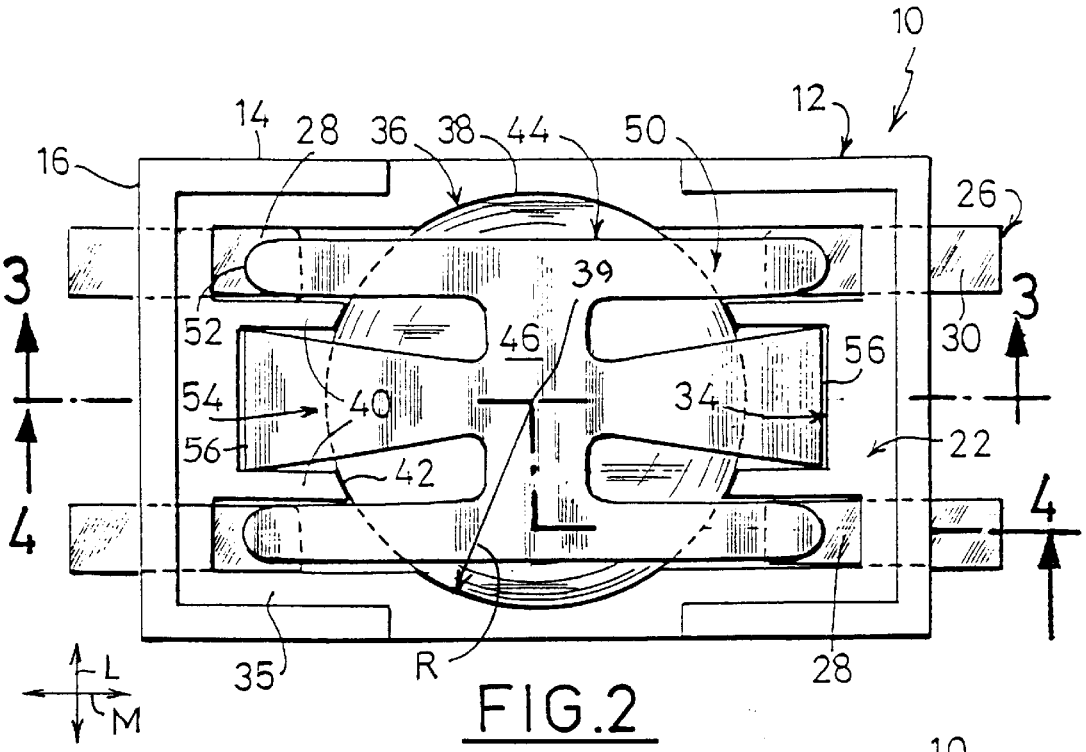
FIG. 2 is a plan view of the assembled switch of FIG. 1.
Figure 4:
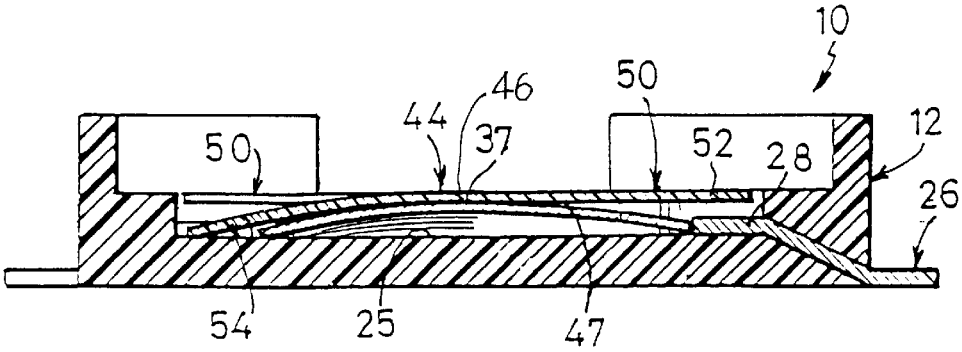
FIG. 4 is a sectional view taken on line 4—4 of FIG. 2, showing the switch in its initial orientation.

Each of the two stabilizing branches 54 is permanently bent to extend at a downward incline. As shown in FIG. 2, the outer end 56 of each stabilizing section is closely positioned between a pair of partitions 40. The stabilizing branches assure that the rest of the contact plate 44 will have the initial position and orientation illustrated. When the center portion 46 and blades 50 are depressed, the stabilizing branches 54 bend to allow such depression. The stabilizing branches define a high vertical rest position of the center portion 46 and blades 50 of the contact plate. It is noted that when the outer ends of the stabilizing branches lie against the bottom 25 of the support, the center portion 46 of the contact plate lies substantially against the center portion 37 of the tripper, as seen in FIG. 4.

Figure 3:
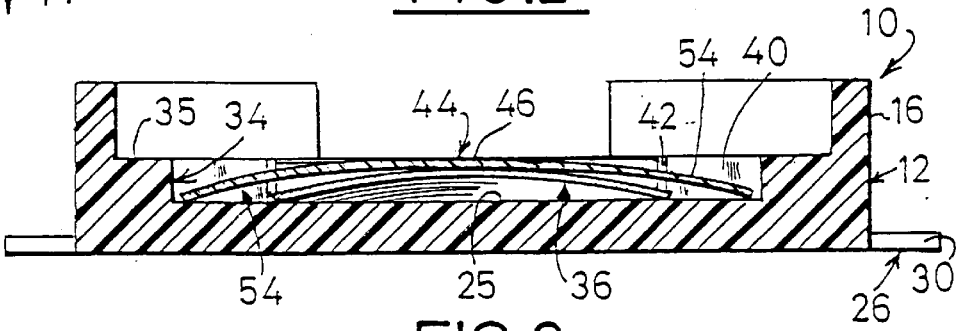
FIG. 3 is a view taken on line 3—3 of FIG. 2, showing the switch in its initial, undeflected orientation.
Figure 5:
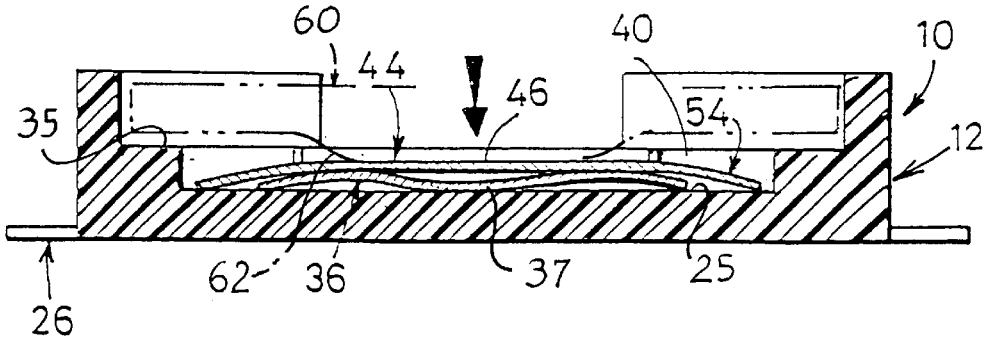
FIG. 5 is a view similar to FIG. 3, but with the center portion of the contact plate depressed to close the switch.
Figure 6:
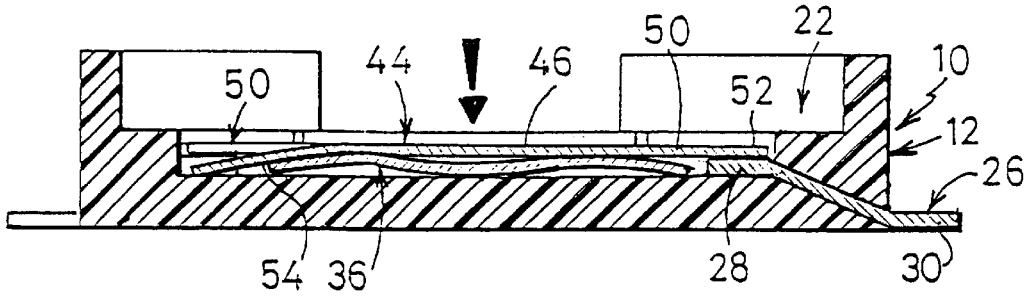
FIG. 6 is a view similar to that of FIG. 4, but with the switch closed.

The switch is initially in the rest position shown in FIG. 3. FIG. 5 shows, in phantom lines, an actuator 60 with a center portion 62 that depresses the center portion 46 of the contact member. The contact member 44, which is initially in the position of FIG. 3, moves down and depresses the center portion 37 of the tripper. When the tripper center portion has been depressed to the position where resistance to further downward movement suddenly drops, the continuing downward force on the contact plate results in the center portions of the contact plate and tripper suddenly moving down. This results in a "snap" action, wherein the actuator 60 rapidly accelerates and then is stopped as the center portion 37 of the tripper hits the bottom wall 25 of the support. As the contact plate and tripper suddenly move down, the free ends 52 (FIG. 6) of the blades 50 suddenly move down against the terminal inner portions 28 to close the switches. It is noted that the contact inner portions 28 are preferably placed high enough or the contact blades are slightly bent downward so that the blade free ends 52 are slightly deflected upward by the terminal to assure good pressure engagement with the terminals.

When the downward force on the contact member center portion 46 is released, the elasticity of the tripper causes it to automatically return to its initially stable state, and raise the contact blade center portion 46 and the blades 50, so the blades lose engagement with the terminals.

In one arrangement, one of the terminals 26 is connected to ground and the other three terminals are connected to circuits that are all grounded only when the switch parts are closed by the contact blades engaging the terminals.

It is possible to provide a resilient sealing film, which is sealed to the surface 35, to seal the contacting surfaces so as to minimize corrosion.

FIG. 1 shows, in phantom lines, the free end 52X of one of the four contact blades initially permanently bent downwardly. This allows the free end at 52X to remain in continuous electrical engagement with one of the four terminals, whether the rest of the switch parts are in opened or closed states.

As shown in FIG. 2, the tripper 36 can have a round periphery 38 so the tripper is of the common snap dome type, which is highly effective in suddenly snapping down to provide a tactile feedback to a person who is depressing the actuator. The tripper has a radius R, and the contact blades 50 extend further from the axis 39 than the tripper periphery, so the blade free ends can engage the terminal end 28 without the tripper 36 lying between the blade ends 52 and the terminals. The stabilizing branches 54 also extend further from the axis 39 than the periphery 38 of the tripper, so the branch free ends can directly engage the support.

Figure 7:
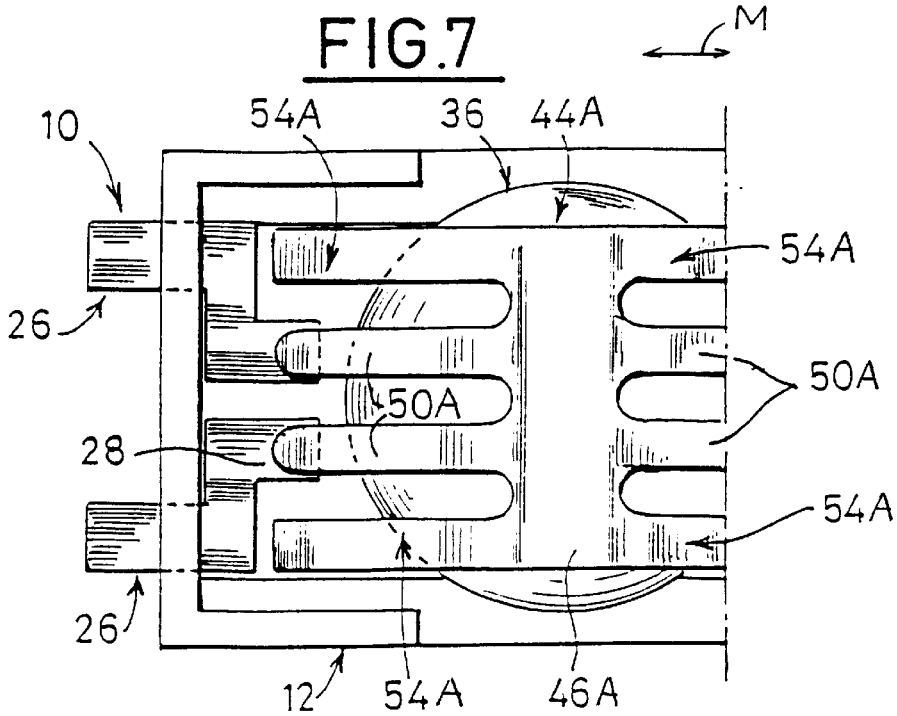
FIG. 7 is a partial plan view of a switch constructed in accordance with another embodiment of the invention.

FIG. 2 shows that the four branches 50 extend in longitudinally M opposite directions from laterally L opposite ends of the contact plate center portion 46, with the stabilizing branches 54 extending longitudinally from the lateral middle of the center portion 46. FIG. 7 shows another embodiment of the invention, where the contact plate 44A has two pairs of stabilizing branches 54A extending in longitudinally M opposite directions from the center portion 46A of the contact plate 44A. Each stabilizing branch 54A is initially bent to extend at a downward incline away from the center portion 46A to position the contact plate.

Although the trip member 36 in FIGS. 1–7 is preferably a piece of sheet metal, it can be constructed of any resilient material since its conductivity or lack thereof does not affect the switching operation. Of course, the contact plate 46 or 46A is constructed of electrically conductive material. It is noted that it is sometimes necessary to test the switch as by placing test probes against the contacting plate and the terminals, as to detect whether one of the blades is making contact with a terminal before the contact plate is depressed. The present switch facilitates such measurement because the contact plate is not covered by the tripper. The contact plate is of minimal width and length because it requires only a center portion and the blades extending therefrom, as compared to the contact plate in earlier U.S. Pat. No. 6,323,449 where the contact plate had to have a peripheral portion from which the blades extend inwardly.

While terms such as "down", "horizontal", etc. have been used to describe the switch and its parts as illustrated, it should be understood that the switch can be used in any orientation with respect to the Earth.

Thus, the invention provides an electrical switch of the type that has a contact plate with blades that can be moved down against terminals on a support and a tripper that resiliently resists depression but permits it to allow the blades to move downward, and especially a tripper that suddenly snaps down, which is of small size and which allows the use of a snap tripper with a largely circular periphery. The contact plate lies on top of the tripper so when the contact plate center portion is depressed it downwardly depresses the tripper, thereby causing blades of the contact plate to move down against the terminals. Free ends of the blades extend horizontally further from the axis of the tripper than the periphery of the tripper. The contact plate includes stabilizing branches with outer ends that are positioned by the support to position the contact plate, with the stabilizing branches preferably permanently bent at downward inclines and being slightly unbent as the center portion of the contact plate is depressed.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical switch which includes a support with a bottom portion, a plurality of terminals with at least a first of said terminals lying at said support bottom portion, a conductive contact plate having a center portion and having at least a first blade extending largely away from said center portion, said first blade lying over and spaced from said first terminal, and a snap tripper with a peripheral portion and a center portion, said tripper constructed so said center portion snaps down when it is deflected downwardly from an initial stable state by more than a predetermined amount, wherein:

said tripper center portion lies between said contact plate center portion and said support bottom portion, so when the contact plate is pushed down it presses down said tripper, said first contact blade having a portion lying beyond said tripper and over said first terminal to move down against said first terminal when said contact plate moves down as said tripper snaps down.

2. The switch described in claim 1 wherein:

said contact plate has a plurality of stabilizing branches that extend from said contact plate center portion and at downward inclines and that have free outer end portions;

said support has walls that lie beside said stabilizing branch free outer end portions to position them.

3. The switch described in claim 2 wherein:

said contact plate has a width in a lateral direction and a length in a longitudinal direction, said lateral and longitudinal directions extending perpendicular to each other and to a vertical direction;

said plurality of stabilizing branches comprise a pair of stabilizing branches that extend in opposite longitudinal directions from said contact plate center portion, and said contact plate has at least a second blade, said first and second blades extending in opposite directions from said contact plate center portion.

4. The switch described in claim 1 wherein:

said contact plate has a plurality of blades that include said first blade, said blades having free ends that are spaced apart and that each lie beyond said tripper, and said plurality of terminals are each located below a corresponding one of said contact blade free ends.

5. The switch described in claim 1 wherein:

said contact plate center portion and tripper center portion each lies on a vertical axis;

said first blade has an outer end portion that is spaced further from said axis than an adjacent portion of said tripper periphery, so said first blade extends beyond said tripper as seen in a top view.

6. An electrical switch comprising:

a support;

a tripper lying on said support, said tripper having an uppermost center portion and having a periphery, and said support having walls that lie about said periphery to position said tripper periphery by limiting its horizontal shifting;

a contact plate with a portion lying above said tripper center portion to depress said tripper center portion when said contact plate center portion is depressed, said contact plate having a plurality of blades with blade free ends lying beyond said tripper periphery, as seen in a top view;

a plurality of terminals mounted on said support at locations under said blade free ends, to be contacted by said blade free ends when said contact plate portion is depressed.

7. The switch described in claim 6 wherein:

said center portions of said tripper and said contact plate portion each lie on a vertical axis;

said periphery of said tripper lies substantially on a circle of predetermined radius, and said blade free end portions and said terminals locations each is spaced further from said axis than said radius.

8. The switch described in claim 6 wherein:

said contact plate includes a plurality of stabilizing branches that have branch free end portions, and said support has walls that lie against said branch free ends to position said branches and therefore said contact plate;

said branch free end portions each extend beyond said tripper periphery.

9. The switch described in claim 8 wherein:

said stabilizing branches are each permanently bent to extend at downward inclines from said contact plate portion to about the level of said tripper periphery portion.

10. The switch described in claim 6 wherein:

said contact plate has a blade part that is permanently deformed to extend at a downward incline away from contact plate center portion, and including a terminal element that lies under said blade part with said blade part engaging said terminal element even when said contact plate center portion is not depressed.

11. A method for snapping down free end portions of contact blades that extend from a center portion of a contact plate, against terminals that each lies on a support at a position under one of said blade free end portions, when the contact plate is depressed, comprising:

placing a center portion of a snap tripper under the contact plate center portion while supporting a peripheral portion of the snap tripper on the support;

depressing the center portion of the contact plate to depress it and the center portion of the tripper, until the tripper snaps down and the center portion of the contact plate snaps down and the contact blades snap down against the corresponding terminals.

* * * * *